US006276895B1

(12) United States Patent
Milana

(10) Patent No.: US 6,276,895 B1
(45) Date of Patent: Aug. 21, 2001

(54) FAN WITH CENTRIFUGAL SHUTTER MECHANISM

(76) Inventor: Angelo Milana, P.O. Box 2091, Center, TX (US) 75935

( * ) Notice: Subject to any disclaimer, the term of this patent is extended or adjusted under 35 U.S.C. 154(b) by 0 days.

(21) Appl. No.: 09/181,210

(22) Filed: Oct. 28, 1998

(51) Int. Cl.[7] ..... F04D 25/14; F04D 25/08

(52) U.S. Cl. ..... 415/25; 415/125; 415/220; 415/223; 416/247 R; 417/359; 417/362; 454/259; 74/3; 74/105; 74/108

(58) Field of Search ..... 415/25, 125, 208.1, 415/211.2, 220, 223; 416/247 R; 74/3, 105, 108; 454/259, 208; 417/359, 360, 362

(56) References Cited

U.S. PATENT DOCUMENTS

| | | | | |
|---|---|---|---|---|
| 1,648,796 | * | 11/1927 | Albrecht | 454/259 |
| 2,037,250 | * | 4/1936 | MacDonald | 415/125 |
| 2,100,439 | * | 11/1937 | Friedman | 417/362 |
| 2,265,112 | * | 12/1941 | Davies | 415/221.2 |
| 2,335,508 | * | 11/1943 | Gustafsson et al. | 415/220 |
| 2,468,366 | * | 4/1949 | Habinski | 415/25 |
| 3,273,788 | * | 9/1966 | Coward, Jr. | 417/362 |
| 3,482,767 | * | 12/1969 | Reinkoester, Jr. | 417/362 |
| 3,917,433 | * | 11/1975 | Tomitaka | 415/148 |
| 4,217,816 | * | 8/1980 | Mancinelli | 415/125 |
| 4,265,591 | * | 5/1981 | Gurbin | 415/148 |
| 5,195,928 | * | 3/1993 | Gigola | 454/362 |
| 5,288,202 | * | 2/1994 | Mancinelli | 415/25 |

* cited by examiner

*Primary Examiner*—Christopher Verdier

(57) ABSTRACT

A fan has an associated centrifugal mechanism and a shutter, comprising a plurality of pivoted vanes and a central vane pivotally interconnected with a pair of heavy tie rods. The centrifugal mechanism is driven by the fan propeller and comprises a hermetic housing wherein are located, symmetrical spaced apart in rapport to the fan axis, at least a pair of radial sliding masses operatively connected with flexible cables to an axial sliding reciprocating actuator which is disposed at proximity of the shutter central vane. When the fan starts to operate in either direction by an electric motor, the radial masses slide radially by centrifugal action and pull the axial reciprocating actuator away from the central vane, allowing the shutter heavy tie rods, to open the shutter. When the fan stops, an internal spring housed within the axial sliding reciprocating actuator pushes it against the central vane causing the closing of the shutter. The fan comprises a compact casing split into half portions connected together by a central structural member holding an electric reversible motor and the propeller.

10 Claims, 5 Drawing Sheets

FAN WITH CENTRIFUGAL SHUTTER MECHANISM

BACKGROUND OF THE INVENTION

1. Field of the Invention

The present invention relates to new and useful improvements in fans equipped with a shutter and designed for moving air into or out of a building and, more particularly, this invention relates to a fan associated with an automatic centrifugal mechanism, adapted for closing the shutter for keeping out wind, rain or other matter, when the fan is off.

2. Description of the Prior Art

Usually fans are provided with gravity shutters which, at low revolution of the fan, cannot operate efficiently because the air pressure head developed by the fan is not sufficient to keep them fully open. Moreover, during fan operation and particularly during storm weather the out-flowing air cause vibrations, noises and wear and significant pressure losses of the fan. In the past, attempts have been made to solve the various problems of said fans and said gravity shutters, whereby various centrifugal systems had been proposed. A description of the prior art known to the applicant, which is pertinent to the present application, may be found in the following Patents:

U.S. Pat. No. 4,217,816; U.S. Pat. No. 5,195,928; U.S. Pat. No. 5,288,202. In the arrangement described in U.S. Pat. No. 4,217,816, the fan comprises a shutter mechanism with two centrifugal masses that, upon rotation of the propeller, transmits an axial force to an axially reciprocating actuator. Said actuator comprises a steel rod guide sliding on a bushing.

The above system works with satisfaction for opening the shutter. However, for closing it, since at low revolutions the centrifugal forces become insignificant, but the gravity forces of the two centrifugal masses are substantially important, at each revolution of the propeller, as the two masses are vertically aligned, there is a significant friction force on said bushing and said steel rod guide may jam; therefore, the shutter will not close completely. The system described in U.S. Pat. No. 5,288,202 is similar to the previous described, therefore, the solution is not satisfactory, the friction forces are still present and the jamming of said centrifugal system is possible.

The centrifugal device described in U.S. Pat. No. 5,195,928 is well known to the applicant. Applicant developed in the past a similar mechanism using three equally spaced rotating masses and found that it works smoothly and with satisfaction, because the steel rod guide causing the aforesaid problems had been eliminated. However, this device is more expensive, comprises too many parts and joints. In addition, it requires a precise balancing and frequent maintenance.

While all the aforementioned mechanisms have the advantage to keep positively open the shutter. However, they have the disadvantage to have an axial reciprocating actuator rotatably connected to the shutter central vane. Thus, when the fan is operating, the vibrations of the propeller and of the centrifugal mechanisms are continuously transmitted to the shutter, causing undesirable noises and wear.

SUMMARY OF THE INVENTION

The longstanding need for a fan equipped with a shutter and an associated novel centrifugal mechanism engineered for continuous operation even at low speed, in highly dusty and corrosive atmospheres, is now fulfilled by the invention disclosed hereinafter and summarized as follows.

The improved fan of this invention comprises: a casing split into half sections having a first opening face, equipped with a self opening shutter assembly, consisting of a plurality of individual streamlined vanes and a central vane rotatably fitted to the fan casing and connected with two heavy tie rods, an orifice for guiding efficiently the air flow produced by the fan propeller, which comprises a plurality of radially extending blades designed for intake and exhaust. The fan casing further comprises a second face equipped with a safety screen and a central structural member adapted for holding an electric reversible motor and said propeller.

The novel centrifugal mechanism rotates with the fan propeller and reacts automatically to fan speed. It is simple in design, compact and it has a minimum number of parts and joints required for high precision and for preventing looseness and vibrations of the mechanism even after long term use.

In dust environments, the dust or other foreign matter are able to collect on the centrifugal mechanism; thus, it is desirable to have its components enclosed in a hermetic housing. The centrifugal shutter mechanism of this invention includes at least a pair of radial sliding masses equally spaced apart in respect to the fan axis and located inside said hermetic housing in a plan perpendicular to the fan axis. Said masses are operatively connected, by means of steel wire cables, to an axial sliding reciprocating actuator comprising an internal spring.

When the fan is rotated in either direction by said electric reversible motor, said centrifugal masses, as the fan reaches the minimum speed of operation slide radially by centrifugal force and pull the axial sliding reciprocating actuator away from the central vane of said shutter against the urge of said compression spring, whereby said reciprocating actuator gradually will free the central vane of said shutter, allowing the pair of heavy tie rods, to rotate said central vane in open position.

When the fan is stopped, the centrifugal forces of said pair of masses decrease, whereby said compression spring progressively expands and push said axial sliding reciprocating actuator against the shutter central vane, which is compelled to rotate gradually around its longitudinal axis in a closed vertical position. As a result, the pair of heavy tie rods rotates all shutter vanes in a closed vertical position.

The centrifugal shutter mechanism can operate for either direction of rotation and therefore the fan can be used for moving air in either direction into or out of a building.

OBJECTS OF THE INVENTION

The main object of this invention is to teach certain improvements made to a fan and associated shutter operating mechanism, whereby the shutter is maintained positively open, when the fan is operating and closed by a centrifugal mechanism and this without using any motor electric power.

Further object of this invention is to provide a versatile low cost fan having an improved compact and light casing of a relatively low cost, requiring minimal installation space and shipping volume.

A further object of the invention is to provide a safe centrifugal mechanism with masses totally enclosed, simple in construction, positive in operation, designed to function for long periods of time and in a very range of speeds without the usual frequent servicing and repairs.

BRIEF DESCRIPTION OF THE DRAWINGS

For a fuller understanding of the innovatory principles, features, advantages and other objects of the present invention with respect to the prior art, reference should be made to the following detailed description of the illustrative embodiment thereof, which is to be taken in connection with the accompanying drawings given by way of example, in which.

DETAILED DESCRIPTION ACCORDING THE PREFERRED EMBODIMENT

While the present invention will be described more fully hereinafter with reference to the accompanying drawings, in which a preferred embodiment of the present invention is shown, it is to be understood at the outset of the description which follows, that persons of the skill in the appropriate arts may modify the invention here described, while still achieving the favorable results of this invention.

Figure 1:
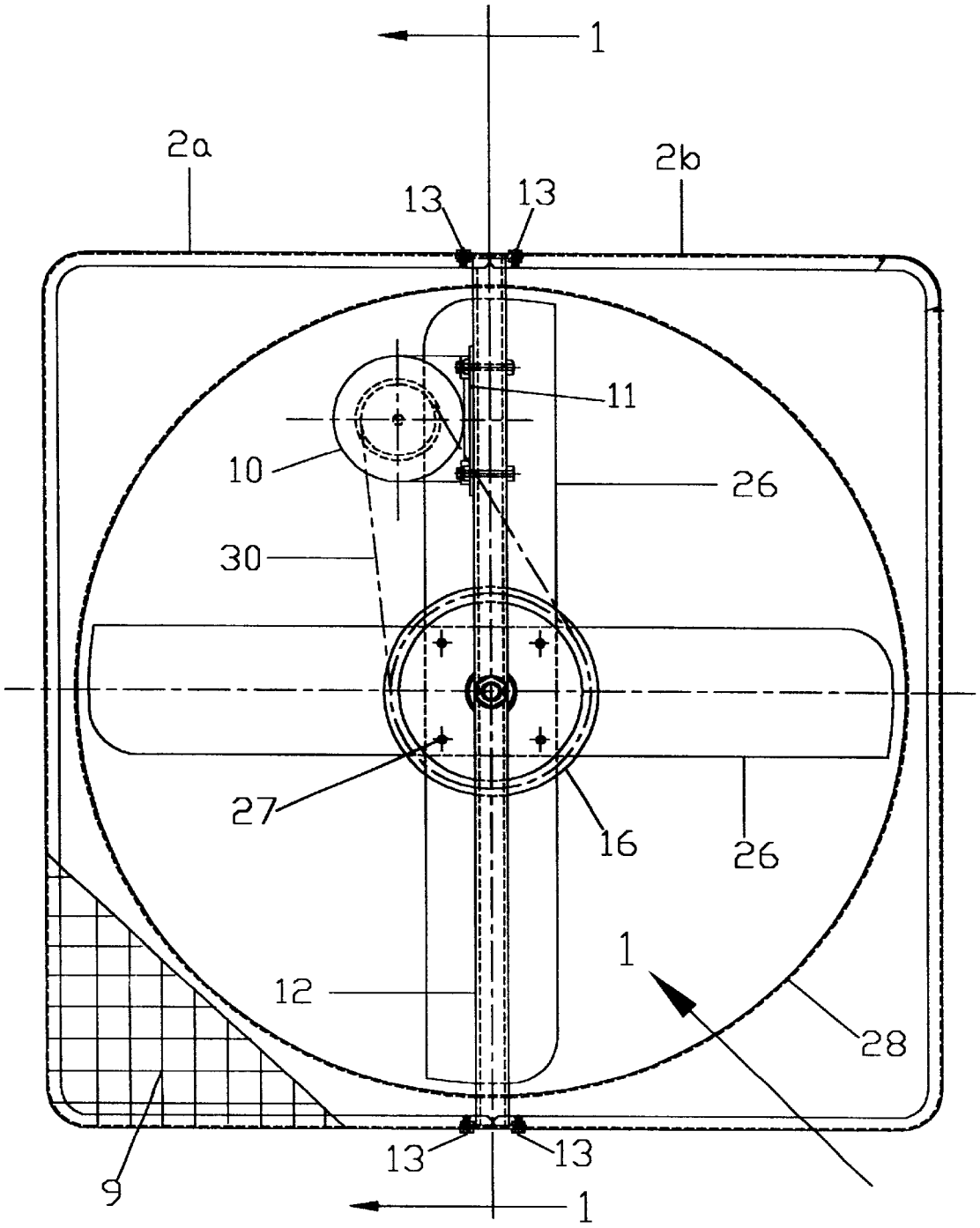
FIG. 1 shows a front elevation view partially in section of the fan, with the shutter removed for clarity.
Figure 2:
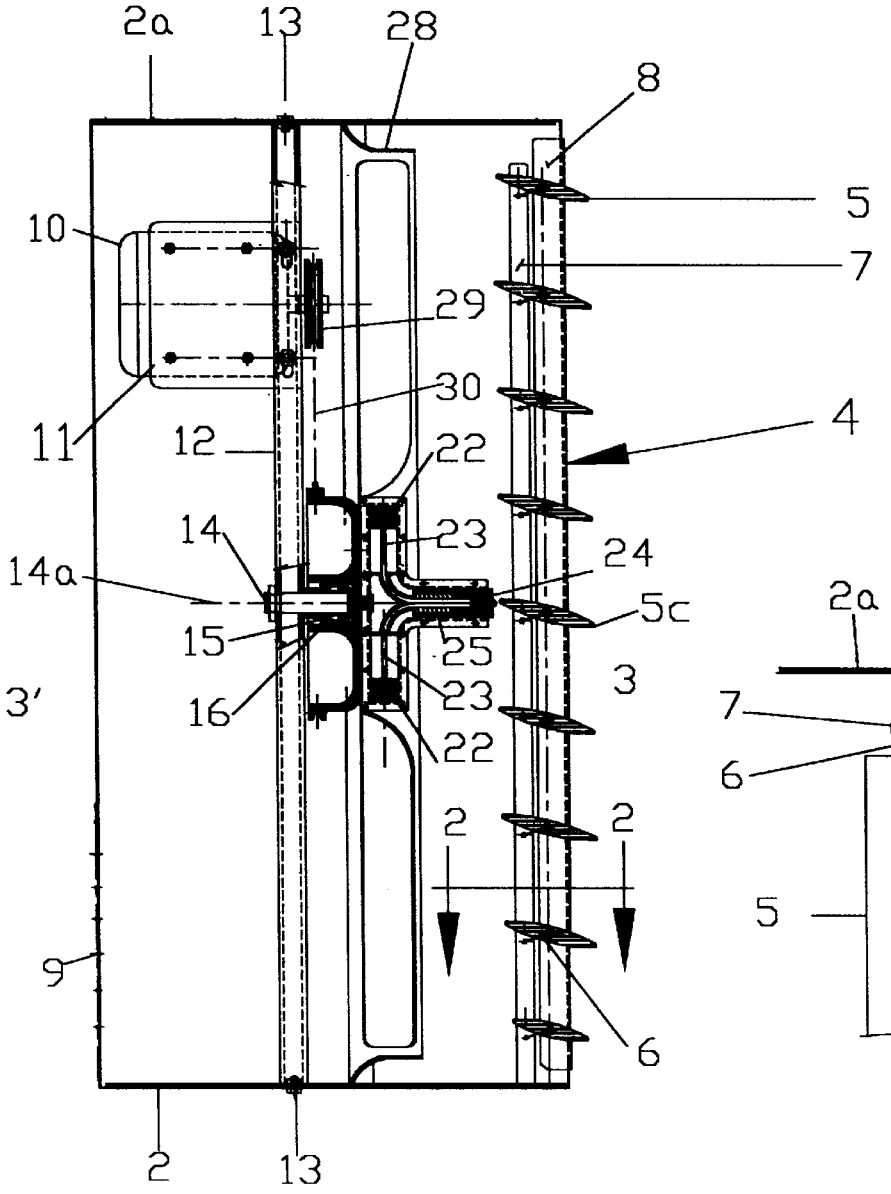
FIG. 2 is a side elevation partially in section of the fan along line 1—1 of FIG. 1, with the shutter in open position.
Figure 3:
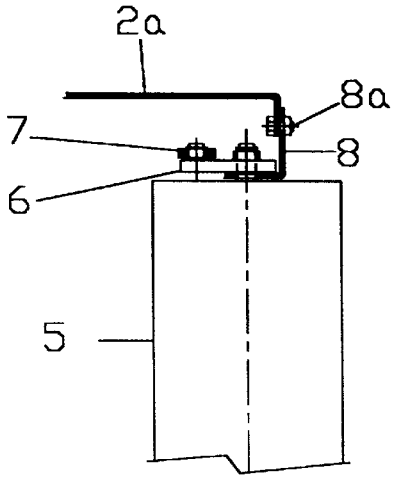
FIG. 3 is an enlarged detail section view along line 2—2 of FIG. 2.
Figure 4:
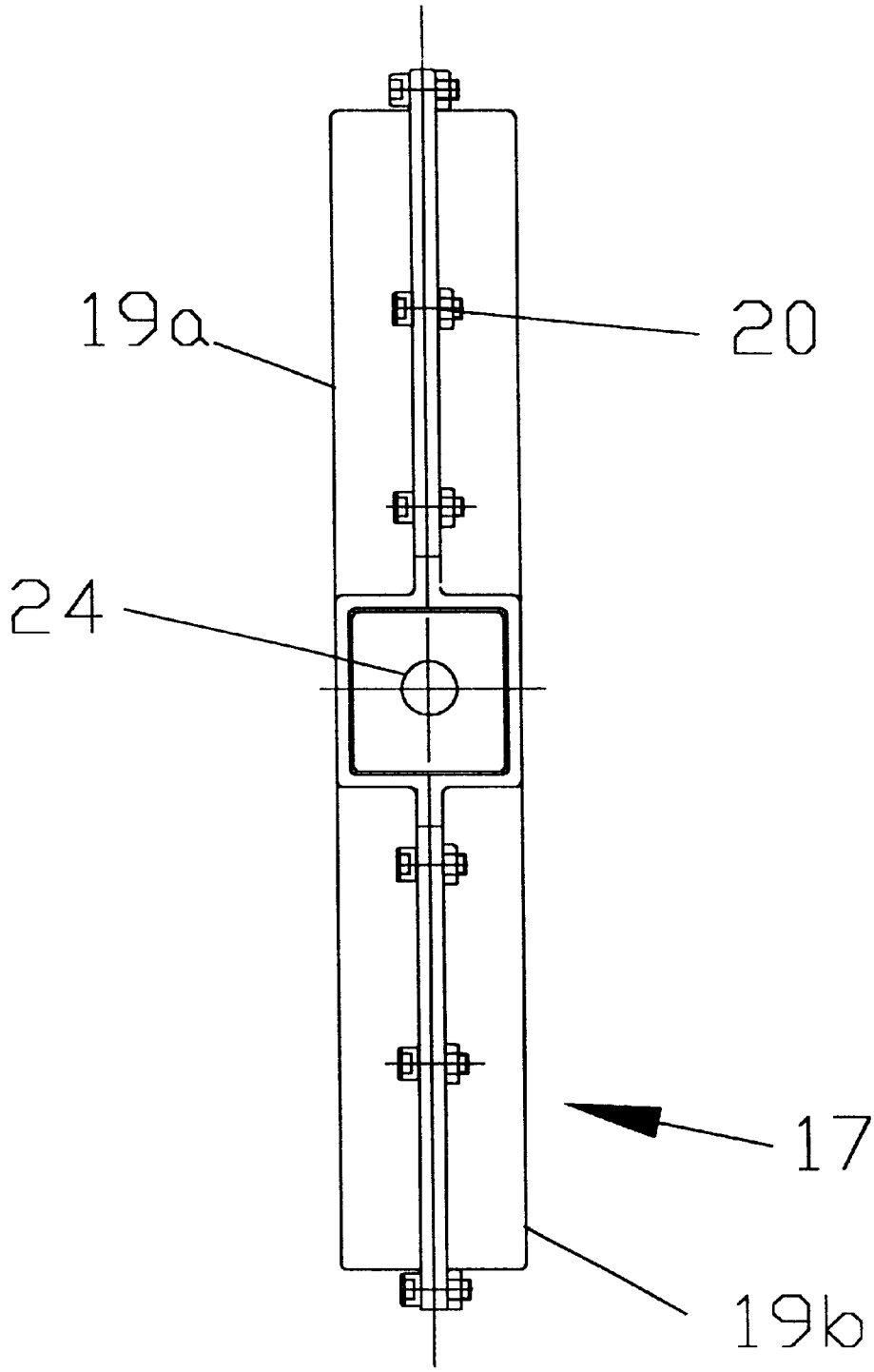
FIG. 4 is a front view of the centrifugal shutter mechanism.

Referring now to the drawings given by way of illustration of a practical embodiment of the present invention, FIGS. 1, 2 and 3 show the components of a fan generally indicated 1 as a whole. These components include an improved stationary compact fan casing 2, which has a parallelepiped construction when seen in perspective, and is split into half sections 2*a*, 2*b* defining a quasi-square section air flow passage with large radii corners for reducing air turbulence and manufacturing cost.

Said improved fan casing comprises a first opening face 3 equipped with a self-opening shutter assembly 4, consisting of a plurality of center pivoted streamlined vanes 5 and a central vane 5*c*, pivotally connected to each other for uniform opening and closing with crank rods 6 and a pair of heavy tie rods 7, vertically extending along each side of said vanes 5. Each shutter vanes 5 has a longitudinally centered pivot mounted on a shutter frame 8, fastened with screws 8*a* to said casing 2.

On the opposite face of the shutter, said casing 2 comprises a second opening face 3' equipped with a safety screen 9.

Further, the fan 1 comprises an electric reversible motor 10, mounted on a base member 11, which can slide on the central structural member 12 which is secured with bolts 13 to the top and bottom wall of the casing 2. Said central structural member 12 is axially spaced from said opening faces of said casing 2 and comprises a stationary central shaft 14 mounted substantially perpendicularly to said central structural member 12 and in the middle thereof and substantially coaxial to the fan or propeller axis. Said central shaft 14 is made with a bolt which holds and locks the inner ring of a single sturdy bearing 15, which has its outside ring fitted into the hub of the fan pulley 16.

As can be clearly seen in FIGS. 2, 4, 5, 6, the novel centrifugal mechanism generally indicated 17 is mounted on one end of pulley 16 and includes a hermetic housing 18, having a T-shape and comprising a pair of matching symmetrical molded shells 19*a*, 19*b* preferably made of plastic having an internal cavity. Each shell has a pair of radially extending cavities, symmetrically spaced in respect to the fan axis of rotation, and an axial extending cavity located coaxial to the fan axis. Further, said shells comprise a pair of symmetrically spaced curbed grooves adapted for guiding said wire cables 23.

Said pair of shells are bolted together by fastening means, like bolts 20, and secured to pulley 16 with bolt 21. The hermetic housing 18 comprises at least a pair of radial steel masses 22 of a parallelepiped form, slidably mounted on said radial cavities, symmetrically spaced in rapport to the fan axis 14*a*, operatively connected to a pair of stainless steel wire cables designed 23, which are operatively connected to the axial sliding reciprocating actuator 24.

Said axial sliding actuator 24 has a parallelepiped form adapted to slide inwardly said hermetic housing 18 away from said shutter central vane 5*c* or outwardly said hermetic housing 18 against said shutter central vane 5*c*.

Figure 5:
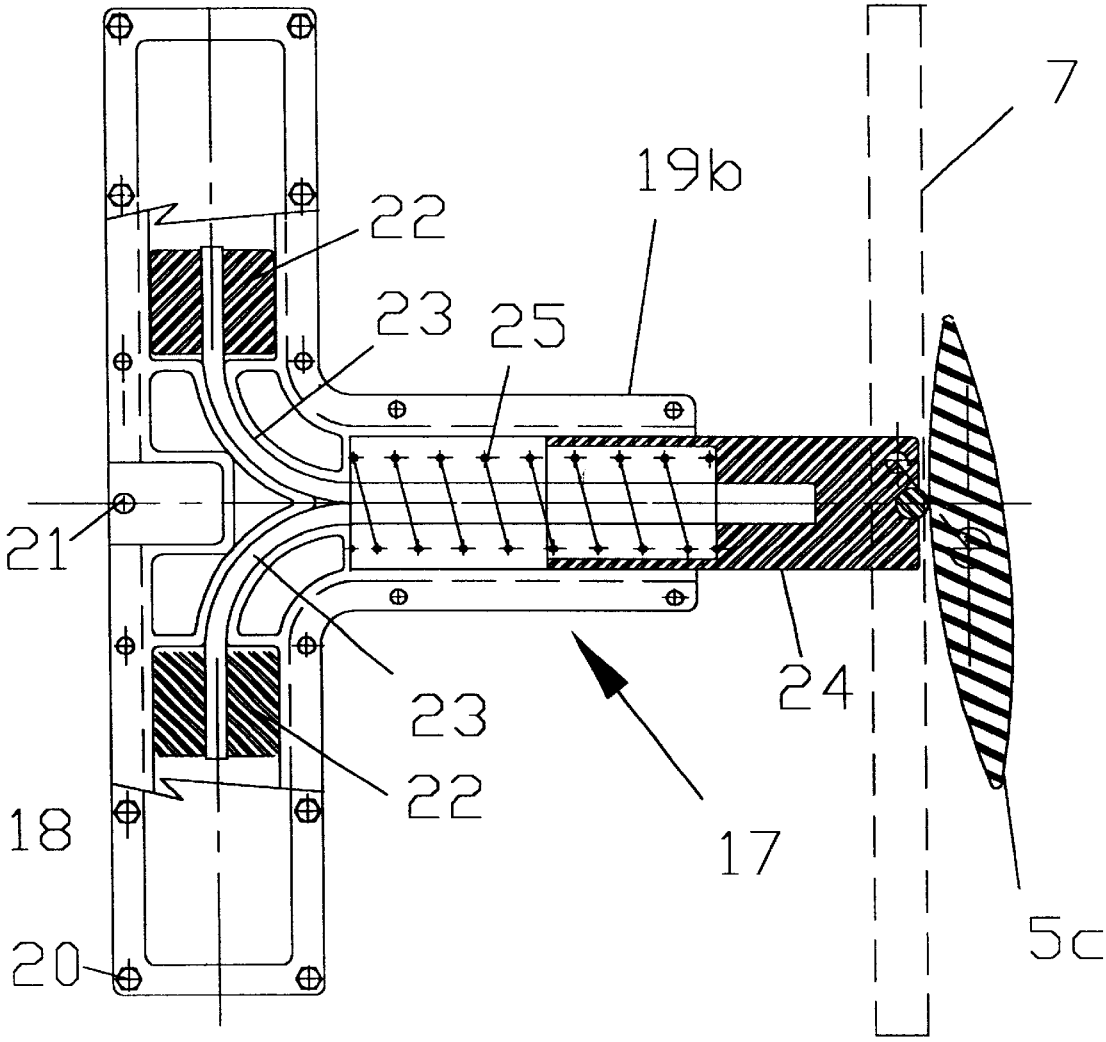
FIG. 5 is a side elevation view partially in section of the centrifugal shutter mechanism, with the shutter in closed position.
Figure 6:
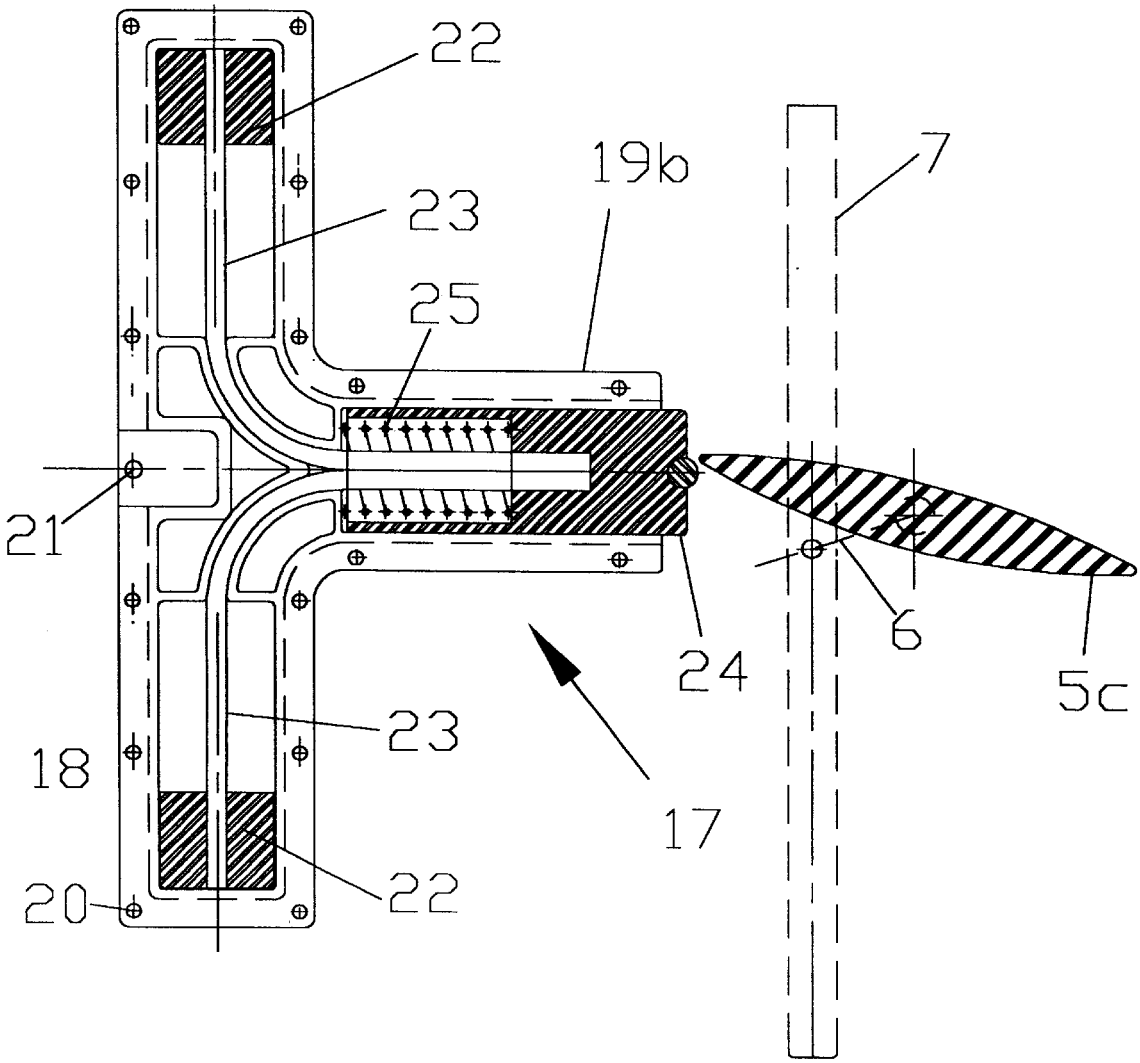
FIG. 6 is a side elevation view looking inside the centrifugal shutter mechanism, with half of the hermetic housing removed for clarity, showing the shutter in an open position. Similar reference numerals refer to similar parts throughout the several views of the drawings.

As it appears most clearly in FIGS. 5 and 6, the axial sliding reciprocating actuator 24 has a front end adapted to engage and slide along the convex surface of said center central vane 5*c*, which as aforesaid is connected with the tie rods 7 to the other shutter vanes, thus is able to rotate them in a open or closed position.

An internal spring 25 located within said axial sliding reciprocating actuator 24 is provided for maintaining a minimum tension on the wire cable 23 and for urging it against said central vane 5*c*. Said spring 25 has one end biased to the inside front wall of the axial sliding reciprocating actuator 24 and the other end biased to the inside wall of said hermetic housing 18, as pictured in FIG. 6.

The fan further comprises a plurality of blades 26 designed for delivering a high volume of air in both directions into or out of said building. Said blades 26 are bolted to the pulley 16 with bolts 27 and are substantially surrounded by the orifice 28, which guides the air produced by the fan blades 26.

The functioning of the novel centrifugal mechanism 17 may readily be understood by reference of FIGS. 1, 2, 5 and 6.

When the fan starts to operate, depending on whether it is desired to take air or exhaust air from said building, the electric motor 10 is started in the appropriate direction, thereby its rotation is transmitted from the motor pulley 29 to belt 30 and to pulley 16 thus, as the fan speed increases, at the minimum normal speed of operation, said radial steel masses 22 start to slide radially, by centrifugal force, pulling, in the same time, wire cables 23 and axial sliding reciprocating actuator 24, which slides inward said housing 18, away from said shutter central vane 5*c* and against the urge of spring 25, thereby said shutter 4 is allowed to open for effect of the forces of the two heavy tie rods 7 which, upon fan rotation, will apply a torque to the shutter vanes, urging them to rotate in an open position.

As can be clearly seen, FIG. 6 shows in detail the centrifugal shutter mechanism in open position, showing the existing gap between the front end of said axial sliding reciprocating actuator 24 and said central vane 5*c*. Thus, the shutter is kept open solely by the weight of the two heavy tie rods 7; therefore, the traditional vibrations, wear and noise through said shutter 4 are eliminated. Moreover, the traditional pressure losses, normally caused when out-flowing air is required to keep the shutter opened. are virtually eliminated.

When the electric motor of said fan is shut off, the propeller speed gradually decreases, so that the centrifugal forces decreases, whereby at a preset speed which corresponds to the minimum design speed of the fan, said compression spring 25 gradually pulls back said centrifugal masses 22 in direction of the center of the fan axis and simultaneously pushes the reciprocating axial sliding reciprocating actuator 24 outwardly from said hermetic housing in direction and against the central vane 5.

In a first moment, said actuator front end closes said existing gap, then enters into contact with the inner part of said convex surface of said central vane 5*c* applying a torque, whereby causing its rotation in a closed vertical position and simultaneously urging the pair of said heavy tie rods 7 to rotate all shutter vanes 5 in their closed vertical position. The torque applied by the axial sliding actuator is resisted by the torque produced by the pair of heavy tie rods.

When the fan is not in operation, the shutter is positively locked, whereby preventing air, rain, and other matter from passing through and there is no chance that the shutter will rattle.

It is evident now that the applicant provides with this invention a simple and effective device that allows a gradual and quiet automatic opening and closing of the shutter.

From the foregoing, it is ready apparent that the applicant provides with this invention a fan having an improved casing, an improved shutter and a novel centrifugal mechanism, which is automatically operable to lock the shutters vanes in their closed position, when the fan is disabled, and unlock them by centrifugal action of said centrifugal masses when the fan is enabled, said opening and closing controlled by the fan speed. The improved fan casing pictured on the present application requires minimal installation space and shipping volume.

In addition, as result of the four substantially large radii corners of said improved strong casing, it will be a substantial reduction of: weight, vibrations, noise level, assembling time, manufacturing cost, accumulation of dust and pressure loss.

Furthermore, since the shutter vanes are substantially centered and streamlined, there is always a balanced pressure on each side of said vanes; therefore, the propeller can blow air in both directions.

The novel centrifugal shutter mechanism can be engineered for different sizes and operating speed and it is useful for many other numberless applications. With the novel centrifugal shutter mechanism, the centrifugal forces of said radial sliding masses are integrally transmitted to the axial sliding reciprocating actuator, whereby the novel centrifugal mechanism needs smaller masses.

Heretofore, only a small component of the centrifugal forces was transmitted to the actuator; therefore, larger masses were needed.

In the drawings and specification, there has been set forth a preferred embodiment of the invention and, although specific terms are employed, there are used in a generic and descriptive sense only and not for purpose of limitation; thus, it will be appreciated by those skilled in the art that variations can be made thereto without departing from the spirit of the invention. It will thus be seen that the objects set forth above and those made apparent from the foregoing description are fully effectively attained.

The embodiments of the invention in which an exclusive property or privilege is claimed are defined as follows:

1. An improved fan, the improvements comprising:

a) a casing of parallelpiped construction defining a quasi-square air flow passage having a first opening including a self-opening shutter consisting of a plurality of vanes and a central vane for closing or opening said first opening, each of said vanes being pivotally interconnected, with crank rods and two heavy tie rods, b) an axially spaced second opening including a safety screen, c) a central structural member axially spaced from said openings, connecting two opposite sides of said casing, d) an electric reversible motor mounted on a rigid base secured to said central structural member, e) a propeller rotatably secured to a central stationary shaft, which is bolted to said central structural member for rotatably holding a fan pulley, on which are mounted a plurality of blades extending radially outwardly therefrom and rotatably therewith, f) an orifice, substantially entirely surrounding said propeller for efficient guide of the air in both directions, g) a centrifugal shutter mechanism, connected for rotation to said propeller, comprising means for moving the shutter from a closed position, when the fan is disabled, to a normally open position when the fan is enabled, and comprising a T-shaped housing assembly, having a pair of sliding centrifugal masses equally spaced apart in rapport to the fan rotational axis, extending radially outwardly therefrom, operatively connected to an axially sliding hollow reciprocating actuator, located coaxial to the fan axis of rotation, at proximity to said central vane, said hollow reciprocating actuator comprising an internal spring and an operative end movable between an outwardly position, engaging said central vane to shut said shutter by the thrust of said internal spring, and an inwardly position, away from said central vane of said shutter, for causing the opening of said shutter in response to the rotation of said propeller, said opening and closing controlled by the minimum speed of operation of said fan.

2. The fan as claimed in claim 1, wherein said fan casing is split into half sections joined to each other for forming the air flow passage with four large corners.

3. The fan as claimed in claim 1, wherein said pair of masses are always sliding along an axis located in a vertical plane and at a fixed distance from the vertical shutter plane.

4. The fan as claimed in claim 1, wherein said central vane of said shutter has a profile adapted for engaging relationship with the operative end of said axial sliding reciprocating actuator of said centrifugal mechanism, for causing the opening or closing of said shutter.

5. The fan as claimed in claim 1, wherein said shutter vanes are streamlined and center pivoted, thereby enabling the fan to blow air without vibrations, noise, and wear.

6. The fan as claimed in claim 5, wherein said shutter vanes are adapted to be opened and keep positively opened by the pair of tie rods, upon fan operation for preventing vibrations, noise and wear and related damage thereto.

7. The fan as claimed in claim 1, wherein said centrifugal shutter mechanism totally enclosed in a hermetic housing.

8. The fan as claimed in claim 1, wherein the radial travel of said centrifugal masses is equal to the axial travel of the axial sliding actuator.

9. The fan as claimed in claim 8, wherein said radial sliding masses are operatively connected to each other and with the axial sliding reciprocating actuator with flexible connecting means.

10. The fan as claimed in claim 7, wherein said hermetic housing comprises a pair of matching symmetrical molded shells, comprising a pair of radially extending symmetrical cavities containing said radial sliding masses, radially and oppositely disposed apart in rapport to the fan axis of rotation, said hermetic housing further comprising an axially extending cavity, containing said axial sliding reciprocating actuator located coaxial to the propeller axis of rotation.

* * * * *